United States Patent [19]

Kurita

[11] 4,239,220

[45] Dec. 16, 1980

[54] TARGET GAME AND COMPONENTS THEREOF

[75] Inventor: Toshiaki Kurita, Tokyo, Japan

[73] Assignee: Tomy Kogyo Co., Inc., Tokyo, Japan

[21] Appl. No.: 946,202

[22] Filed: Sep. 27, 1978

[30] Foreign Application Priority Data

Sep. 28, 1977 [JP] Japan ..... 52-130276

[51] Int. Cl.[3] ..... F41J 7/00

[52] U.S. Cl. ..... 273/127 R; 273/122 R; 273/127 D; 273/129 S

[58] Field of Search ..... 273/102.1 E, 105.6, 273/102 AP, 127 D, 86 D, 102.1 C, 102.1 D, 101, 119 R, 119 A, 121 R, 121 A, 122 R, 122 A, 129 GA, 127 R, 129 S, 386, 392

[56] References Cited

U.S. PATENT DOCUMENTS

| | | | |
|---|---|---|---|
| 986,683 | 3/1911 | Bugbee | 273/102.1 E |
| 1,533,795 | 4/1925 | Foans | 273/102.1 E |
| 1,571,503 | 2/1926 | Barber | 273/127 D |
| 1,652,843 | 12/1927 | Trout | 273/102.1 E |
| 1,748,030 | 2/1930 | Wetzell | 273/119 R |
| 2,835,495 | 5/1958 | Lohr et al. | 273/101 |
| 3,531,120 | 9/1970 | Ross et al. | 273/101.2 |
| 3,647,213 | 3/1972 | Baker | 273/101 |
| 3,834,701 | 9/1974 | Hashimoto | 273/101 |
| 3,843,128 | 10/1974 | Licitis et al. | 273/101.2 |
| 3,899,170 | 8/1975 | Parks et al. | 273/102.1 E |
| 4,039,188 | 8/1977 | Goldfarb et al. | 273/102.1 E |

FOREIGN PATENT DOCUMENTS

| | | | |
|---|---|---|---|
| 487027 | 10/1952 | Canada | 273/102.1 D |
| 2707055 | 8/1977 | Fed. Rep. of Germany | 273/101.1 |
| 770869 | 7/1934 | France | 273/129 GA |

OTHER PUBLICATIONS

Mechanisms, Linkages, and Mechanical Controls, N. P. Chironis, p. 142.

*Primary Examiner*—Anton O. Oechsle
*Attorney, Agent, or Firm*—Edward D. O'Brian

[57] ABSTRACT

A target game can be constructed utilizing a support member and a transparent housing or cover mounted on the support member so as to enclose an elongated, enlarged area. A target is movably mounted on a guide rail within this area so as to be capable of being moved between the ends of a path. A spring is located on the support member for moving the target from adjacent to one end of the path to adjacent to the other end. An escapement structure consisting of parts mounted on the support and on the target controls such movement so that the target member only moves incrementally each time it is engaged by a projectile. A shooting structure is pivotally mounted on the support so as to be accessible from the exterior of the housing. This shooting structure includes a hollow tube within which there is carried a plunger capable of being manipulated so as to shoot projectiles. A feed passage leads into this tube for conveying projectiles into the interior of the tube when the shooting structure is pivoted so that this feed passage is aligned with a projectile feed channel located generally between the support member and the housing.

2 Claims, 5 Drawing Figures

TARGET GAME AND COMPONENTS THEREOF

BACKGROUND OF THE INVENTION

The invention set forth in this specification pertains to new and improved target games and components for such games.

It is well known that there are many different types of target games. Normally such games employ two separate components: a shooting mechanism and a target mechanism or structure. These components are normally constructed so as to be capable of being utilized together in such a manner that a projectile propelled or shot by the shooting mechanism indicates whether or not the shooting mechanism has or has not been used in the intended manner by either marking the target in one manner or another or by being retained by the target in one manner or another, or by actuating the target in one manner or another.

The target games of the present invention employ a target apparatus of the latter type having a target which is adapted to be actuated by a projectile. Such target apparatuses have been constructed in a wide variety of manners. Most commonly they have been constructed so as to utilize either a specific lever or similar structure mounted in a fixed location or mounted on a belt or similar type movable structure so as to be capable of being pivoted when actuated during the movement of the belt or a similar structure. The precise shooting mechanism employed with any specific such actuated target apparatus will of course vary depending upon the nature of the particular target game involved. Common firearms are on occasion used with such games. When such games are to be employed with children it is more conventional to utilize a spring-loaded plunger type mechanism for propelling a ball serving as the projectile.

At the present time it is considered that target apparatuses of a type adapted to be actuated by a projectile as a target is moved from one location to another tend to be unnecessarily complex and expensive. This tends to preclude such target apparatuses from being utilized in comparatively small, inexpensive toys. The use of such target apparatuses in such toys is highly desirable because of the established amusement values of target apparatuses in which a target is moved along a path. Also it is considered that the shooting mechanisms employed with prior target games for shooting projectiles such as balls are comparatively undesirable for use in small games in which a target is moved because they do not adequately provide for movement of the shooting mechanism out of a shooting position after such a mechanism is actuated.

SUMMARY OF THE INVENTION

It is believed it will be apparent from the preceding that the invention is intended to provide new and improved components—more specifically, a new and improved movable target apparatus and a new and improved shooting mechanism—for use in target games. The invention is also intended to provide new and improved target games employing such components in which the components cooperate with one another so as to provide an effective, complete target game mechanism or structure. Further objects of the invention are to provide such games and components which are relatively inexpensive to construct, which are easily and conveniently manufactured, and which are capable of operating reliably over a prolonged period. All of these factors are important in providing comparatively inexpensive target games and components of a size permitting such games and components to be utilized either as or as parts of comparatively small toys.

In accordance with this invention a target apparatus which includes a support member, target means movably mounted on the support member so as to be capable of being moved along a path is provided with the improvement which comprises:

motive means connecting to the target means for moving the target means along the path from adjacent to a first end thereof to adjacent to a second end thereof, escapement means having a ratchet means and an escapement lever means for controlling the motion of the target means along the path from adjacent to the first end thereof to adjacent to the second end thereof, the ratchet means being mounted on the support and the escapement lever being mounted on the target means, the escapement lever means being responsive to the target means being engaged by a projectile so as to permit the motive means to incrementally advance the target means along the path from adjacent to the first end thereof to adjacent to the second end thereof in successive increments each time the target means is engaged by a projectile.

In accordance with this invention such a target apparatus is preferably located within the space between the support member and a housing or cover so as to be located opposite and away from a shooting mechanism. In accordance with this invention a shooting mechanism including a hollow tube, a plunger slidable within the tube and extending to the exterior of the tube and spring means for biasing the plunger toward the interior of the tube is provided with the improvement which comprises: a rotatably mounted carrier, the tube being located on the carrier so as to be rotatable therewith; said carrier including a feed passage leading into the tube from the exterior of the carrier and intersecting the tube between the ends of the tube in a position in which a projectile such as a ball can move into the interior of the tube through the feed passage when the plunger is moved generally away from the tube so as to place the spring means in a position where it will automatically return the plunger so as to cover the intersection between the tube and the feed passage.

BRIEF DESCRIPTION OF THE DRAWING

Because of the nature of the invention it is considered that it is best more fully described with reference to the accompanying drawing in which.

Figure 1:
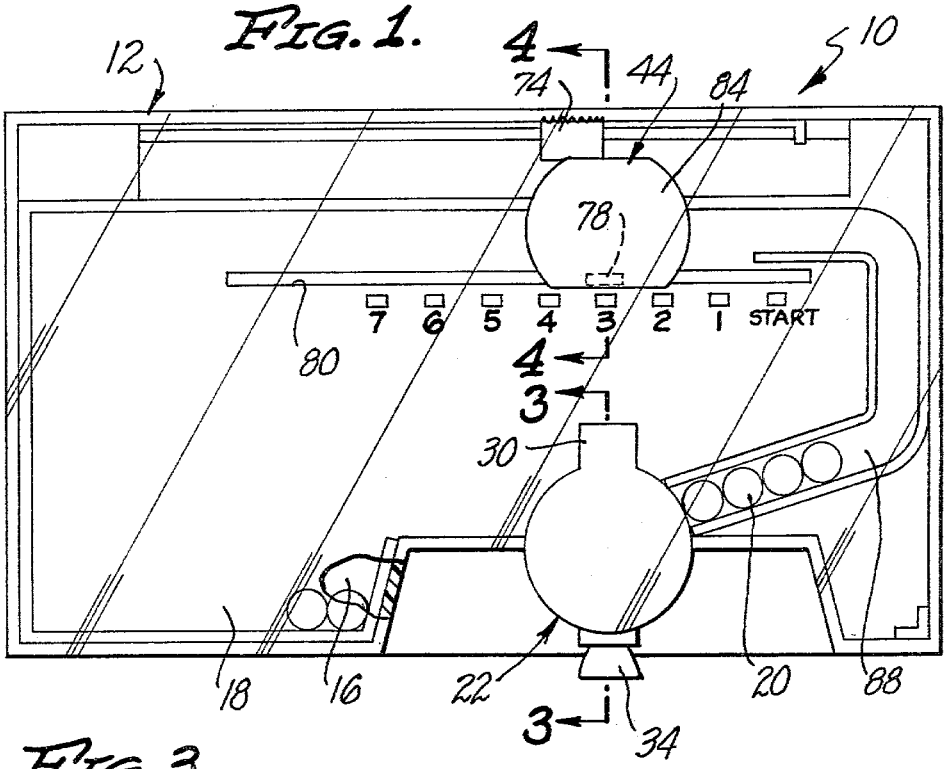
FIG. 1 is a top plan view of a presently preferred embodiment or form of a target game of the invention.
Figure 3:
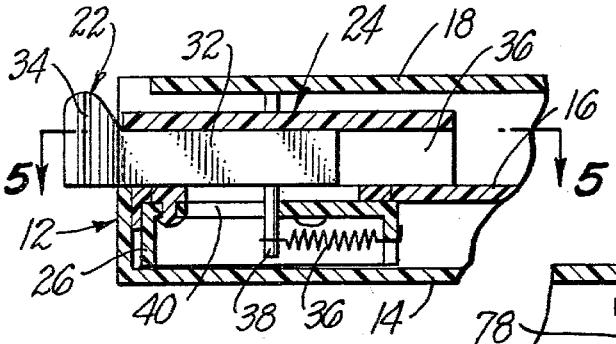
FIG. 3 is a partial cross-sectional view at an enlarged scale taken at line 3—3 of FIG. 1.
Figure 4:
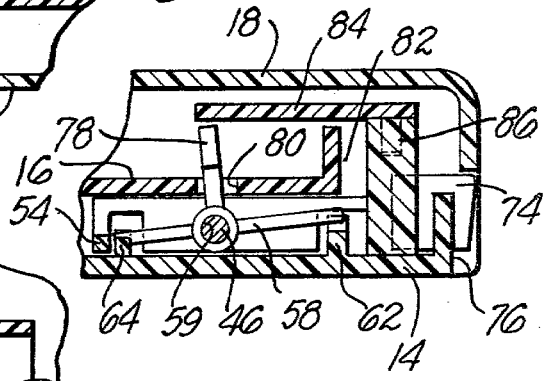
FIG. 4 is a partial cross-sectional view at an enlarged scale taken at line 4—4 of FIG. 1.
Figure 5:
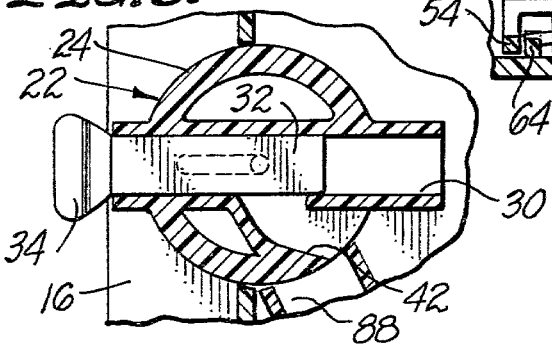
FIG. 5 is a partial cross-sectional view taken at line 5—5 of FIG. 3.

It will be realized that the particular structure illustrated embodies concepts or principles as are verbally expressed in the appended claims forming a part of this specification. Those skilled in the design and construction of mechanical toys will easily realize that these concepts or principles can be easily employed through the use of routine skill in a wide variety of differently appearing and somewhat differently constructed target apparatuses, shooting mechanisms and complete target games.

DETAILED DESCRIPTION

In the drawing there is shown a target game 10 which is constructed so as to utilize a support member 12 consisting of a tray-like base 14 and a floor 16 supported on the base 14 so that there is space between this base 14 and the floor 16. The support member 12 is adapted to be covered by a transparent cover or housing 18 which is designed to prevent the possible loss or misplacement of various balls 20 serving as projectiles in connection with the use of this game 10.

A shooting mechanism 22 is incorporated within this game 10. This particular shooting mechanism 22 includes a cylindrical carrier 24 provided with a cylindrical base 26 of slightly larger diameter than the carrier 24 itself. A cylindrical opening 28 of slightly larger diameter than the carrier 24 and of lesser diameter than the base 26 is provided in the floor 16 so that the entire shooting mechanism 22 can be retained in place by virtue of the base 26 fitting between the floor 16 and the base 14 in such a manner that it can be rotated about its axis.

This carrier 24 supports an elongated tube 30 extending from the carrier 24 into the space between the housing 18 and the floor 16. A conventional plunger 32 is slidably mounted in the tube 30 so as to be accessible from the exterior of the housing 18. This plunger 32 includes the usual enlarged head 34 which is adapted to be manually manipulated in order to distend a spring 36 during the use of the shooting mechanism 22. The spring 36 is mounted between a projection 38 on the plunger 32 fitting within a slot 40 in the bottom of the tube 30 and the interior of the base 26. If desired, of course, other equivalent structures can be employed.

The shooting mechanism 22 is provided with a feed passage 42 extending from the periphery (not separately numbered) of the carrier 24 into the tube 30 intermediate the ends (not separately numbered) of this tube 30. This feed passage 42 is located so that when the plunger 32 is withdrawn from the interior of the tube 30 to the maximum extent possible because of the engagement of the projection 38 with the slot 40 a ball 20 can enter the interior of the tube 30 so as to be propelled across the floor 16 when the plunger 32 is released.

During the utilization of the game 10 the shooting mechanism 22 is manipulated so as to be turned in order to be directed toward a target mechanism or apparatus 44 which is located generally along the portions of the game 10 remote from the shooting mechanism 20. This target mechanism 44 includes an elongated rod 46 serving as a guide rail mounted on lugs 48 on the base 14. A small carriage 50 including aligned openings 52 is located so that these openings 52 are intersected by this rod 46. The carriage 50 is supported in this manner so that it can be moved along a linear path corresponding to the length of the rod 46. Preferably this carriage 50 includes terminal legs 54 engaging the base 14 so as to be slidably supported against rotation. This carriage 50 is also provided with a top opening 56 utilized to carry an escapement lever 58.

The escapement lever 58 forms a part of a double ratchet escapement 60 including two ratchet racks 62 and 64. These racks 62 and 64 are located on the base 14 parallel to the rod 46. The rack 64 is formed so that the vertical walls of its teeth are on the right sides of these teeth as viewed in FIG. 2. This is important as far as the operation of the lever 58 is concerned. This lever 58 is provided with a centrally located opening 59 extending around the rod 46 so that it may be rocked back and forth during the use of the complete escapement 60 and so that it in effect is carried by or supported by the carriage 50.

The operation of this escapement 60 requires that motive power be provided to the carriage 50 in order to move the carriage 50 during the use of the target mechanism 44. Such motive power is provided through the use of a coil spring 68 located beneath the floor 16 so as to extend from a projection 70 on the base 14 around an appropriate guide 72 intended to facilitate the spring 68 expanding and contracting along the rack 62 where it is attached to the carriage 50.

Figure 2:
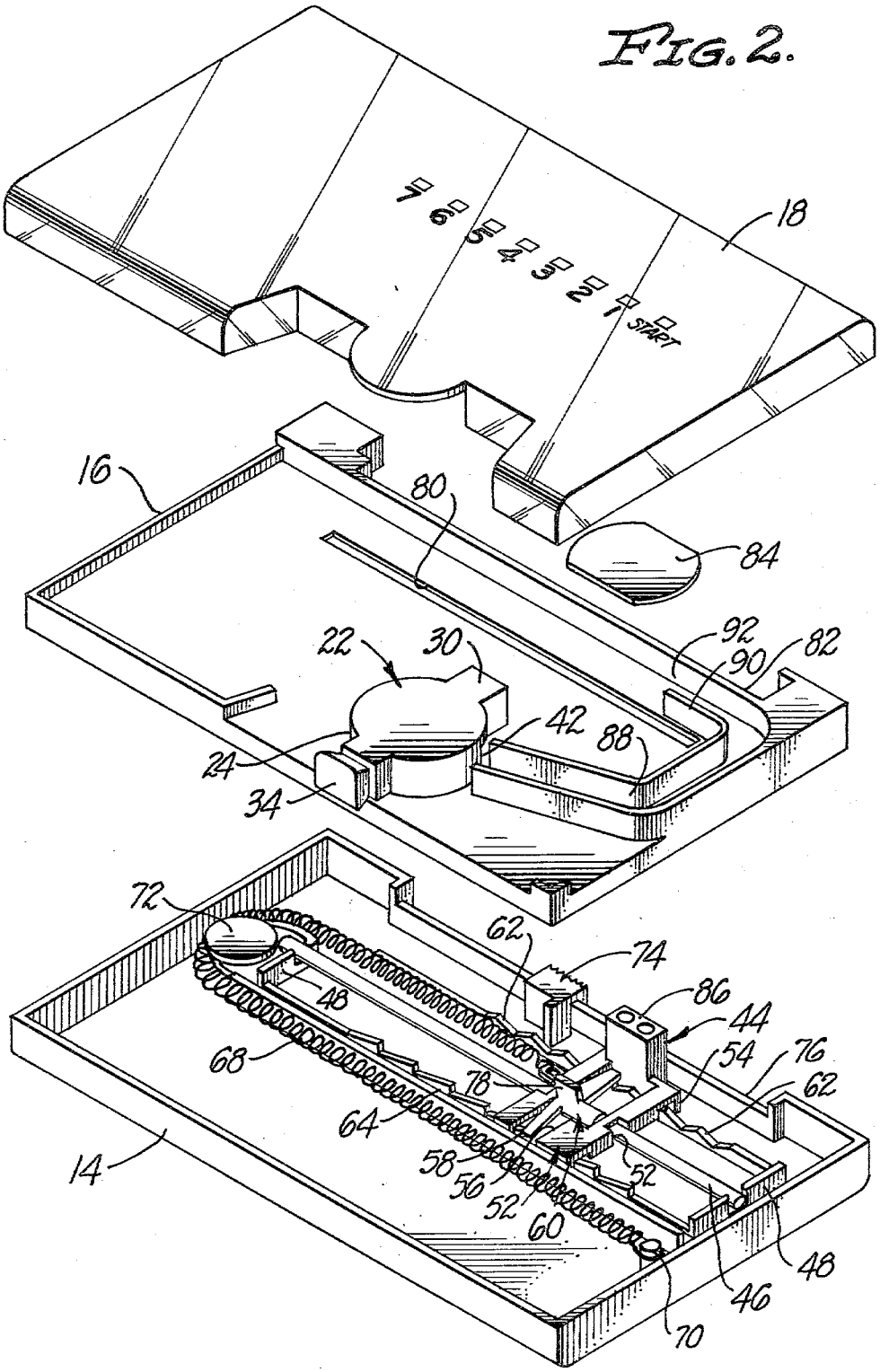
FIG. 2 is an exploded view in which parts of the target game are illustrated in isometric projection.

With this construction a small slider 74 mounted in a conventional manner in an elongated slot 76 on the base 14 generally between this base 14 and the floor 16 may be manually engaged so as to push the slider 74 against the carriage 50 in order to move the carriage 50 from adjacent to the left side of the game 10 as viewed in FIGS. 1 and 2 to adjacent to the right side of the game 10 as viewed in the same figures. When the carriage 50 is moved in this manner the spring 68 will be placed under tension and will have an automatic tendency to move the carriage 50 back toward the left hand side of this game 10 as viewed in FIGS. 1 and 2.

Such movement is normally prevented by the operation of the escapement 60. The teeth in the racks 62 and 64 are arranged so that the lever 58 is normally biased when the spring 68 is under tension so as to be engaged by a tooth in the rack 64 to hold the carriage 50 against movement. When the lever 58 is rotated the carriage 50 will be temporarily released from the rack 64 and will be pulled toward the left as viewed in FIGS. 1 and 2 by the spring 68. As this motion of the carriage 50 occurs the lever 58 will engage the back side of a tooth on the rack 62 in order to pivot the lever 58 so that it will engage the next tooth on the rack 64 to secure the carriage 50 against further movement.

It will be realized this mode of operation involves incremental movement of the carriage 50. In the game 10 such incremental movement is initiated by individual balls 20 propelled by the mechanism 22 hitting against a projection 78 serving as a target or target member extending upwardly from the lever 58 through a slot 80 in the floor 16.

With this structure each time a ball 20 is propelled through the use of the shooting mechanism 22 if the shooting mechanism 22 has been properly oriented, such a ball 20 will engage the projection 78 so as to turn the escapement lever 58 about the rod 46 in order to cause an incremental advance of the carriage 50 as indicated in the preceding. Thus, with the game 10 this projection 78 successively changes positions incrementally as the game 10 is used. If desired a further slot 82 may be provided in the floor 16 so that a cover plate 84 may be mounted on a support 86 on the carriage 50 so as to extend over the projection 78. This cover plate 84 may be conveniently utilized to carry an indicia relative to the game 10.

In order to use the game 10 effectively a plurality of the balls 20 must of course be employed. Such balls 20 are supplied to the feed passage 42 each time the carrier 24 is rotated so that this feed passage 42 is aligned with a feed chute 88 defined by internal walls 90 on the floor 16 extending upwardly toward the housing 18. During the start of the use of the game 10 all of the balls 20 are preferably located within the chute 88 by manipulation of the entire game 10 so that the balls roll into an entrance 92 in this chute 88. As the game 10 is used various balls which have been propelled by the mechanism 22 accumulate within the interior of the housing 18 remote from the target mechanism 24 by virtue of the fact that the floor 16 is slightly sloped generally toward the shooting mechanism 22.

It is considered that an important aspect or feature of this invention lies in the fact that balls to be shot through the use of the mechanism 22 can only be "loaded" in the feed passage 42 so as to be available for use in the mechanism 22 when the carrier 24 is rotated so as to align the feed passage 42 with the chute 88. As a consequence of the orientation of the feed passage 42 as shown this means that a user has to pivot the shooting mechanism 22 periodically as it is used and as the projection 78 is advanced along the line of the slot 80. This is considered to contribute to the play values of this game 10.

I claim:

1. A target apparatus which includes a support member, target means movably supported on said support member so as to be capable of being moved along a path in which the improvement comprises:

motive means connected to said target means for moving said target means along said path from adjacent to a first end thereof to adjacent to a second end thereof, escapement means having a ratchet means and a pivotally mounted escapement lever means for controlling the motion of said target means along said path from adjacent to the first end thereof to adjacent to the second end thereof, said ratchet means being mounted on said support and said escapement lever means being movably mounted on said target means, said ratchet means including two ratchet racks, each of which is located parallel to said path, one of said racks being located so that the vertical walls of its teeth face toward said first end, the other of said racks having teeth shaped so as to pivot said escapement lever means into engagement with the first of said racks, said escapement lever means being pivotally mounted on said target means so as to be capable of being pivoted between positions in which said lever means engages either one of said racks but does not engage the other, said escapement lever means being responsive to said target means being engaged by a projectile so as to permit said motive means to incrementally advance said target means along said path from adjacent to the first end thereof to adjacent to the second end thereof in successive increments each time said target means is engaged by a projectile.

2. A target apparatus as claimed in claim 1 wherein:

said escapement lever means is capable of moving during movement of said target means so as to accommodate said target means being moved from adjacent to the second end of said path to adjacent to the first end of said path, said target means includes a carriage, said support member includes guide rail means engaging said carriage so that said carriage can only move along a linear path, said motive means comprises a spring connecting said target means to said support member.

* * * * *